United States Patent [19]

Kataoka

[11] Patent Number: 5,042,253

[45] Date of Patent: Aug. 27, 1991

[54] HYDRAULIC-PNEUMATIC CYLINDER DEVICE WITH ANNULAR FLEXIBLE BAG AS INTERFACE

[75] Inventor: Noboru Kataoka, Anjoh, Japan

[73] Assignee: Ishigame Machinery Co., Ltd., Aichi, Japan

[21] Appl. No.: 442,221

[22] Filed: Nov. 28, 1989

[30] Foreign Application Priority Data

May 15, 1989 [JP] Japan ..... 1-55584[U]

[51] Int. Cl.[5] ..... F15B 7/00

[52] U.S. Cl. ..... 60/560; 60/591; 91/4 R; 91/443

[58] Field of Search ..... 60/560, 565, 568, 571, 60/583, 591; 91/4, 464, 443, 449, 452; 92/82, 142, 83

[56] References Cited

U.S. PATENT DOCUMENTS

| | | | |
|---|---|---|---|
| 383,232 | 5/1888 | Marsh | 92/142 |
| 1,042,534 | 10/1912 | Dawley | 91/4 |
| 1,389,635 | 9/1921 | Dunkle | 92/82 |
| 2,165,095 | 7/1939 | Frechette | 91/4 |
| 2,976,845 | 3/1961 | Goldring | 60/560 |
| 3,029,904 | 4/1962 | Goldring | 188/313 |
| 3,507,189 | 4/1970 | Beckett et al. | 91/466 |
| 3,851,713 | 12/1974 | Fedosenko et al. | 91/4 R |
| 4,046,060 | 9/1977 | Becker et al. | 91/415 |
| 4,072,013 | 2/1978 | Barbareschi | 60/583 |
| 4,121,449 | 10/1978 | Cele | 91/4 R |
| 4,787,206 | 11/1988 | Fabrowsky | 60/565 |

FOREIGN PATENT DOCUMENTS

| | | |
|---|---|---|
| 3436679 | 4/1986 | Fed. Rep. of Germany . |
| 1414842 | 9/1965 | France . |
| 1417702 | 10/1965 | France . |
| 1558368 | 1/1969 | France . |
| 1242128 | 8/1971 | United Kingdom . |

OTHER PUBLICATIONS

Hydraulische Komponenten—Ölhydraulik und pneumatik 18 (1974), No. 12, p. 909.

*Primary Examiner*—Edward K. Look
*Assistant Examiner*—F. Daniel Lopez
*Attorney, Agent, or Firm*—William H. Eilberg

[57] ABSTRACT

A hydraulic-pneumatic cylinder device of the invention comprises a tubular housing closed at both ends, and an actuating piston slidably guided in the housing and connected to a piston rod. A pair of hydraulic units, each of which comprises a pair of volume-variable liquid chambers in communication with each other through a flow control passage, are arranged within the housing on both sides of the piston to act thereon in opposite axial directions. A pair of air chambers, which are selectively connectable to an air supply source, are also provided within the housing to act on the respective hydraulic units. Operation of the cylinder device can be reliably adjusted by a flow regulating valve provided at each flow control passage.

21 Claims, 6 Drawing Sheets

HYDRAULIC-PNEUMATIC CYLINDER DEVICE WITH ANNULAR FLEXIBLE BAG AS INTERFACE

BACKGROUND OF THE INVENTION

1. Field of the Invention

This invention relates generally to cylinder devices wherein an actuating piston connected to a piston rod is reciprocated to conduct an intended operation by utilizing the reciprocating movement of the piston rod. More particularly, the invention relates to a cylinder device which relies on pneumatic drive power but yet is controlled hydraulically. Such a cylinder device is hereinafter referred to as "hybrid cylinder device" for short.

2. Description of the Prior Art

Various types of cylinder devices are available in the market, and now widely used in various applications. Generally, the conventional cylinder devices are roughly classified into two basic types, namely, the hydraulic type and the pneumatic type.

Hydraulic cylinder devices utilize a working oil or liquid which is substantially incompressible even under a high pressure operating condition. Therefore, the hydraulic cylinder is capable of providing precise control and fine adjustment of piston rod movement. For this reason, the hydraulic cylinder is frequently used in applications, such as machine tools, XY or XYZ measuring tables, and industrial robots, which require high precision.

Pneumatic cylinder devices, on the other hand, utilize air which is easily compressible even under a relatively low working pressure. However, the working air has an advantage of being infinitely available anywhere at no cost. Further, pneumatic circuitry for operating the pneumatic cylinder device can be made much simpler and less costly than hydraulic circuitry. Therefore, the pneumatic cylinder is mainly used in applications wherein economy is more important than operating accuracy.

Obviously, the conventional cylinder devices, either hydraulic or pneumatic, have disadvantages of their own. For example, the hydraulic cylinder device is disadvantageous in that it inevitably becomes expensive due to strict requirements for its hydraulic circuit in addition to requiring frequent maintenance. The pneumatic cylinder device is defective in the difficulty of accurately controlling and finely adjusting piston rod movement because of easy compressibility of the air.

SUMMARY OF THE INVENTION

It is, therefore, an object of the present invention to provide a hybrid cylinder device which is capable of accurately controlling and finely adjusting piston rod movement without involving cost problems and requiring frequent maintenance.

Another object of the present invention is to provide a hybrid cylinder device which is capable of conducting a drastic operational mode change by a simple operation.

A further object of the present invention is to provide a hybrid cylinder device which can generate a high power.

Still another object of the present invention is to provide a hybrid cylinder device wherein a single hydraulic unit is used to control piston rod movement in both axial directions.

According to the present invention, there is provided a hydraulic-pneumatic cylinder device comprising: tubular housing means hermetically closed at both ends; an actuating piston axially slidably guided within the tubular housing means; a piston rod connected to the piston and axially extending in the housing means to project out through one end thereof; an air chamber disposed within the housing means, the air chamber being pressurizable to cause movement of the piston in one axial direction; a hydraulic unit associated with the air chamber and arranged within the housing means to act on one side of the piston, the hydraulic unit including an input liquid chamber adjoining the air chamber via interface means, an output liquid chamber adjoining the one side of the actuating piston, and at least one flow control passage provided with adjustable flow control means and communicating with the input and output liquid chambers, the interface means being capable of allowing volumetric variation of the input liquid chamber, the output liquid chamber being variable in volume in complementary relation to the volumetric variation of the input liquid chamber to cause axial movement of the actuating piston; and complementing means arranged within the housing means to act on the other side of the piston for causing movement thereof in the opposite axial direction.

According to the arrangement described above, the hydraulic unit has two liquid chambers in order to make room for providing therebetween a flow control passage which is used for piston movement control. Therefore, the piston movement control can be conducted hydraulically without relying on air which is easily compressible, thereby enabling accurate control and fine adjustment of piston rod movement.

On the other hand, the cylinder device takes its drive power from an air supply source, so that a less costly pneumatic circuit can be used to introduce the air into the cylinder device. However, the air does not participate in controlling the piston movement, so that easy compressibility of the air poses no problem.

The hydraulic unit may be used to control piston rod movement only in the advancing direction for example, whereas the returning movement of the piston rod may be achieved for example by a coil spring which is compressed by the advancing movement of the piston rod. Such a manner of movement control is often acceptable in applications, such as machine tools, wherein accurate movement control is necessary only at the time of machining a workpiece during the advancing stroke of the piston rod, i.e., the tool held thereby.

Alternatively, the combination of the air chamber and the hydraulic unit may be used to move the piston rod in one axial direction, whereas the piston rod may be moved in the opposite axial direction by a similar combination of an additional air chamber and an additional hydraulic unit. In this way, the movement of the piston rod can be accurately controlled in both axial directions, as required for applications in measuring apparatuses for example.

In a further alternative arrangement, the single hydraulic unit may be utilized for accurately controlling piston rod movement in both axial directions. Such an arrangement is advantageous in that the cylinder device requires a smaller amount of working liquid but yet provides an equal or larger stroke for the piston rod.

Preferably, the interface means is provided in the form of a flexible bag defining therein the input liquid chamber of the hydraulic unit. The flexible bag provides a large pressure receiving area to enable the cylinder device to generate a large output.

Other objects, features and advantages of the present invention will be fully understood from the following detailed description of preferred embodiments given with reference to the accompanying drawings.

DETAILED DESCRIPTION OF THE PREFERRED EMBODIMENTS

Figure 1:
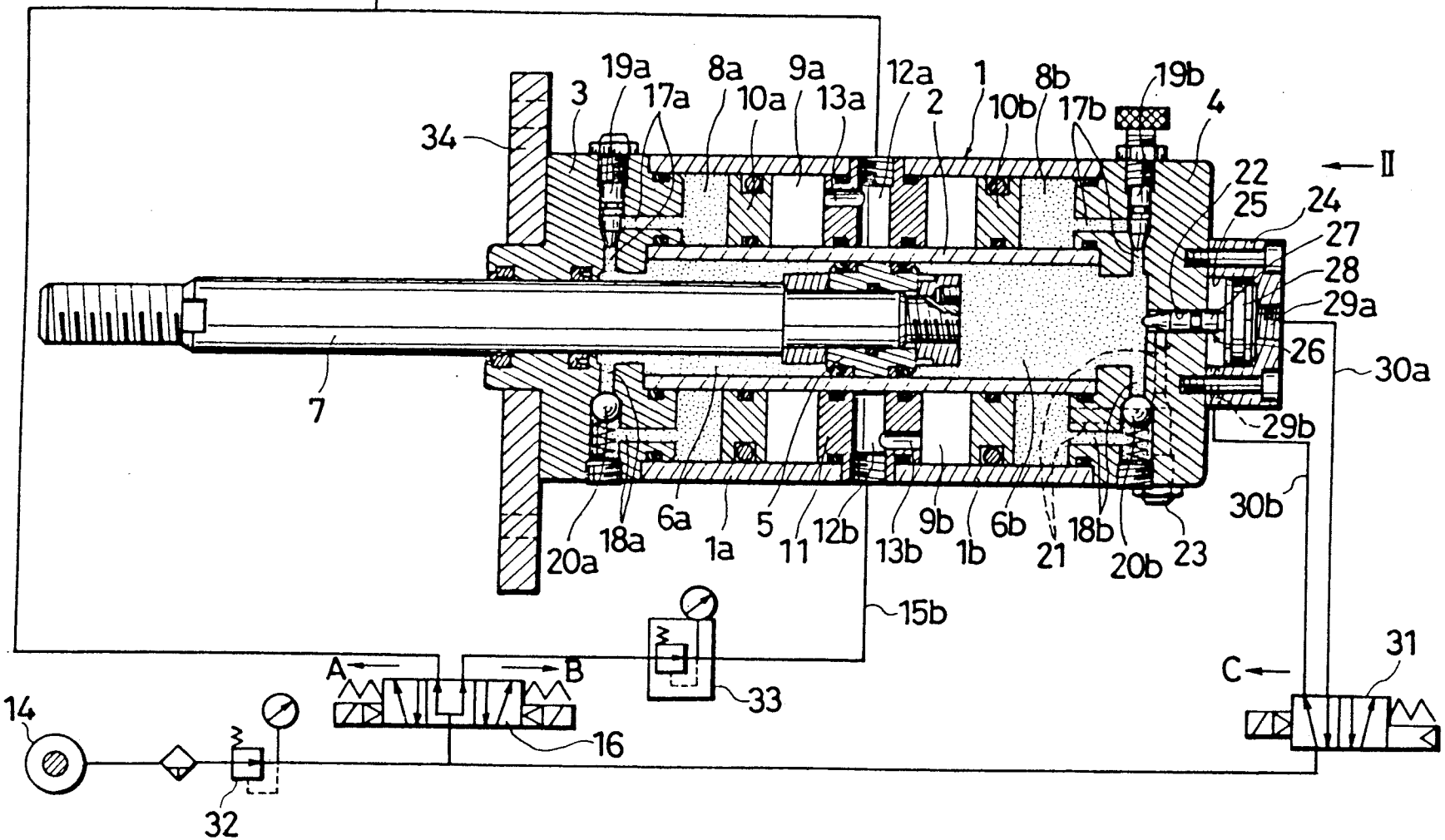
FIG. 1 is a side view, in longitudinal section, showing a hybrid cylinder device according to a first embodiment of the present invention.
Figure 2:
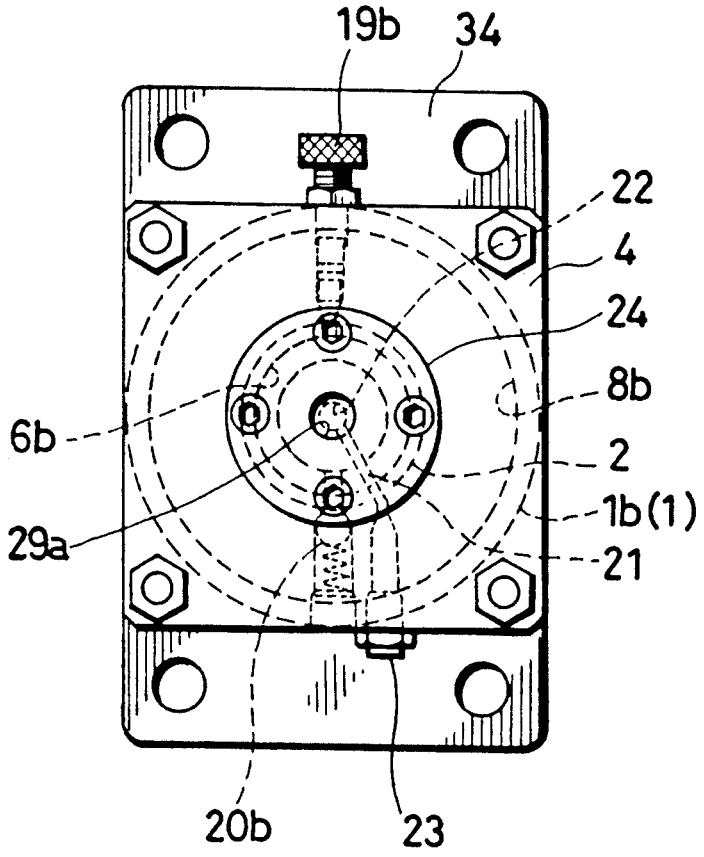
FIG. 2 is a view of the same cylinder device as seen in the direction of an arrow II in FIG. 1.

Referring to FIGS. 1 and 2 of the accompanying drawings, there is shown a hybrid cylinder device according to a first embodiment of the present invention. This cylinder device includes an outer tube 1, and an inner tube 2 arranged coaxially with the outer tube but spaced radially therefrom. The respective tubes have front ends hermetically closed by a common front cover 3. Similarly, the respective tubes have rear ends hermetically closed by a common rear cover 4.

An actuating piston 5 is slidably guided in the inner tube 2. This piston hermetically separates the interior space of the inner tube into a first inner oil chamber 6*a* closer to the front cover 3, and a second inner oil chamber 6*b* closer to the rear cover 4. The piston is connected to a piston rod 7 which extends forward to hermetically penetrate through the front cover 3.

The annular space formed between the respective tubes 1, 2 is divided into four chambers which include a first outer oil chamber 8*a*, a second outer oil chamber 8*b*, a first air chamber 9*a*, and a second air chamber 9*b*. The first outer oil chamber 8*a* and the first air chamber 9*a* are associated with the first inner oil chamber 6*a*, and separated hermetically from each other by a first annular interface piston 10*a* slidably guided between the respective tubes 1, 2. The second outer oil chamber 8*b* and the second air chamber 9*b* are associated with the second inner oil chamber 6*b*, and separated hermetically from each other by a second annular interface piston 10*b* slidably guided between the respective tubes.

According to the illustrated embodiment, the outer tube 1 has two tube segments which include a first tube segment 1*a* defining the first outer oil chamber 8*a* and the first air chamber 9*a*, and a second tube segment 1*b* providing the second outer oil chamber 8*b* and the second air chamber 9*b*. The first and second tube segments 1*a*, 1*b* are hermetically separated from each other but joined together by means of an intermediate annular connector 11.

The annular connector 11 has a first radial air supply port 12*a* communicating with the first air chamber 9*a* through a first communication passage 13*a*. The connector further has a second radial air supply port 12*b* communicating with the second air chamber 9*b* through a second communication passage 13*b*. The first and second air supply ports 12*a*, 12*b* are selectively connectable to a compressed air source 14 and to the atmosphere by way of main air lines 15*a*, 15*b* and a first or main changeover valve 16, as more clearly described hereinafter.

The front cover 3 is formed with a first flow control passage 17*a*, and a first return passage 18*a*. These passages establish communication between the first inner oil chamber 6*a* and the first outer oil chamber 8*a*. The flow of the working oil through the first flow control passage 17*a* is adjustably controlled by a first flow regulating valve 19*a* mounted to the front cover. A first check valve 20*a* is disposed in the first return passage 18*a*, so that the working oil can flow through the return passage only from the first inner oil chamber 6*a* to the first outer oil chamber 8*a*.

Similarly, the rear cover 4 is formed with a second flow control passage 17*b*, and a second return passage 18*b*. These passages establish communication between the second inner oil chamber 6*b* and the second outer oil chamber 8*b*. The flow of the working oil through the second flow control passage 17*b* is adjustably controlled by a second flow regulating valve 19*b* mounted to the rear cover. A second check valve 20*b* is disposed in the second return passage 18*b*, so that the working oil can flow through the second return passage only from the second inner oil chamber 6*b* to the second outer oil chamber 8*b*.

According to the illustrated embodiment, the rear cover 4 is further provided with an auxiliary flow control passage 21 communicating with the second outer oil chamber 8*b*. This auxiliary passage also communicates with a central bore 22 of the rear cover 4 which in turn communicates with the second inner oil chamber 6*b*. The oil flow through the auxiliary passage 21 is controlled by an auxiliary flow regulating valve 23 mounted to the rear cover.

Mounted externally to the rear cover 4 is a mode control box 24 which defines a valve seating space 25. A mode control valve 26 is housed in the mode control box 24. More specifically, the mode control valve, which is in the form of a needle valve according to the illustrated embodiment, comprises a needle 27 hermetically and slidably guided in the central bore 22 of the rear cover 4, and a pressure receiving disc 28 hermetically and slidably guided in the valve seating space 25 of the mode control box.

The mode control box 24 is formed with a first control port 29*a* communicating with the valve seating space 25 on one side (rear side) of the valve disc 28. The mode control box is further formed with a second control port 29*b* communicating with the valve seating space on the other side (front side) of the valve disc. The respective control ports 29*a*, 29*b* are selectively connectable to the compressor 14 by way of respective auxiliary air lines 30*a*, 30*b* and a second or auxiliary changeover valve 31. Thus, the valve needle 24 moves back and forth when the compressed air is selectively introduced through the respective control ports 29*a*, 29*b*. Such reciprocating movement of the valve needle causes opening and closing of the auxiliary flow control passage 21 relative to the second inner oil chamber 6*b*, as more clearly described hereinafter.

In operation, the air compressor 14 continuously supplies compressed air to the respective changeover valves 16, 31. The air pressure supplied to the changeover valves 16, 31 is adjusted at a predetermined level by a main pressure control valve 32. When the main changeover valve 16 assumes its neutral position shown in FIG. 1, the compressed air is simultaneously fed into the respective air chambers 9*a*, 9*b* through the main air lines 15*a*, 15*b*.

As appreciated in FIG. 1, the actuating piston 5 provides a smaller pressure receiving area in the first inner oil chamber 6*a* than in the second inner oil chamber 6*b* due to the presence of the piston rod 7 in the first inner oil chamber. Therefore, if the same pressure is simultaneously applied to the respective air chambers 9*a*, 9*b* to equally pressurize the oil in the first and second inner oil chambers 6*a*, 6*b* through pressurization in the first and second outer oil chambers 8*a*, 8*b*, the total force tending to move the actuating piston 5 leftward in FIG. 1 becomes larger than the total force tending to move the actuating piston rightward, thereby causing the actuating piston to move leftward as a net result. Thus, it is necessary to apply different pressures through the main air lines 15*a*, 15*b* to retain or hold the actuating piston 5 or the piston rod 7 at a fixed axial position.

According to the embodiment illustrated in FIG. 1, one main air line 15*b* is provided with a second pressure control valve (pressure relief valve) 33 which is designed so that the air pressure is smaller at the second air supply port 12*b* than at the first air supply port 12*a*. Such an inlet pressure difference compensates for the above-mentioned difference in the pressure receiving area of the actuating piston 5 on both sides thereof. In this way, equal counteracting forces act on the actuating piston to stop it at any axial position when the main changeover valve 16 is brought to its neutral position. Obviously, the second pressure control valve 33 is designed to relieve air at a lower pressure level than the main pressure control valve 32.

It is now supposed that the mode control valve 26 takes the position of FIG. 1 wherein the needle 27 assumes its retreated position to open the auxiliary flow control passage 21. In this condition, the auxiliary changeover valve 31 takes its rightward position shown in FIG. 1, so that the second control line 30*b* is connected to the compressor 14, while the first control line 30*a* opens into the atmosphere.

Under the above condition, when the main changeover valve 16 is shifted in the direction of an arrow A in FIG. 1, the second air supply port 12*b* alone is connected to the compressor 14 through the line 15*b*, whereas the first air supply port 12*a* is held open to the atmosphere through the other line 15*a*. As a result, the second air chamber 9*b* expands to move the second interface piston 10*b* rightward in FIG. 1 by displacing the oil in the second outer oil chamber 8*b* into the second inner oil chamber 6*b* through the second flow control passage 17*b* as well as through the auxiliary flow control passage 21. Obviously, the second return passage 18*b* is not effective at this time because it allows the oil flow only from the second inner oil chamber 6*b* to the second outer oil chamber 8*b*. In this way, the actuating piston 5 together with the piston rod 7 is caused to advance. It should be appreciated that the advancing speed of the piston rod can be precisely controlled by regulating the oil flow through the second flow control passage 17*b* and the auxiliary flow control passage 21, i.e., by adjusting the second flow regulating valve 19*b* and the auxiliary flow regulating valve 23.

On the other hand, the advancing movement of the piston 5 causes a volumetric reduction of the first inner oil chamber 6*a*, thereby displacing the oil therein into the first outer oil chamber 8*a* mainly through the first return passage 18*a* (the first check valve 2O*a*) and partially through the first flow control passage 17*a*. As a result, the first interface piston 10*a* moves rightward in FIG. 1 to expel the air from the first air chamber 9*a* into the atmosphere.

When the main changeover valve 16 is shifted in the direction of an arrow B in FIG. 1, the first air supply port 12*a* is connected to the compressor 14 through the line 15*a*, whereas the second air supply port 12*b* is rendered open to the atmosphere through the other line 15*b*. Such shifting causes the actuating piston 5 together with the piston rod 7 to retreat substantially in the same manner as already described above. The retreating speed of the piston rod 7 can be precisely or finely adjusted by controlling the first flow regulating valve 19*a*.

When the auxiliary changeover valve 31 is shifted in the direction of an arrow C, the first control line 30*a* is connected to the compressor 14, whereas the second control line 30*b* is rendered open to the atmosphere. As a result, the valve needle 27 advances to close the auxiliary flow control passage 21. Thus, only the second flow control passage 17*b* remains effective, so that the advancing speed of the piston rod 7 is drastically reduced when the main changeover valve 16 is shifted in the direction of the arrow A in FIG. 1. In other words, the advancing speed of the piston rod 7 can be varied stepwise by advancing and retreating the mode control valve 26 in addition to being steplessly adjusted by controlling the second flow regulating valve 19*b* and/or the auxiliary flow regulating valve 23. Such stepwise speed control may be utilized to enable a faster advancing stroke at the initial stage of position setting and a slower advancing stroke at the ending stage of position setting, thereby assuring a quick but exact position setting as a whole.

The hybrid cylinder device according to the present invention may be mounted to a suitable position of a relevant apparatus such as machine tool by using a mounting flange 34.

Figure 3:
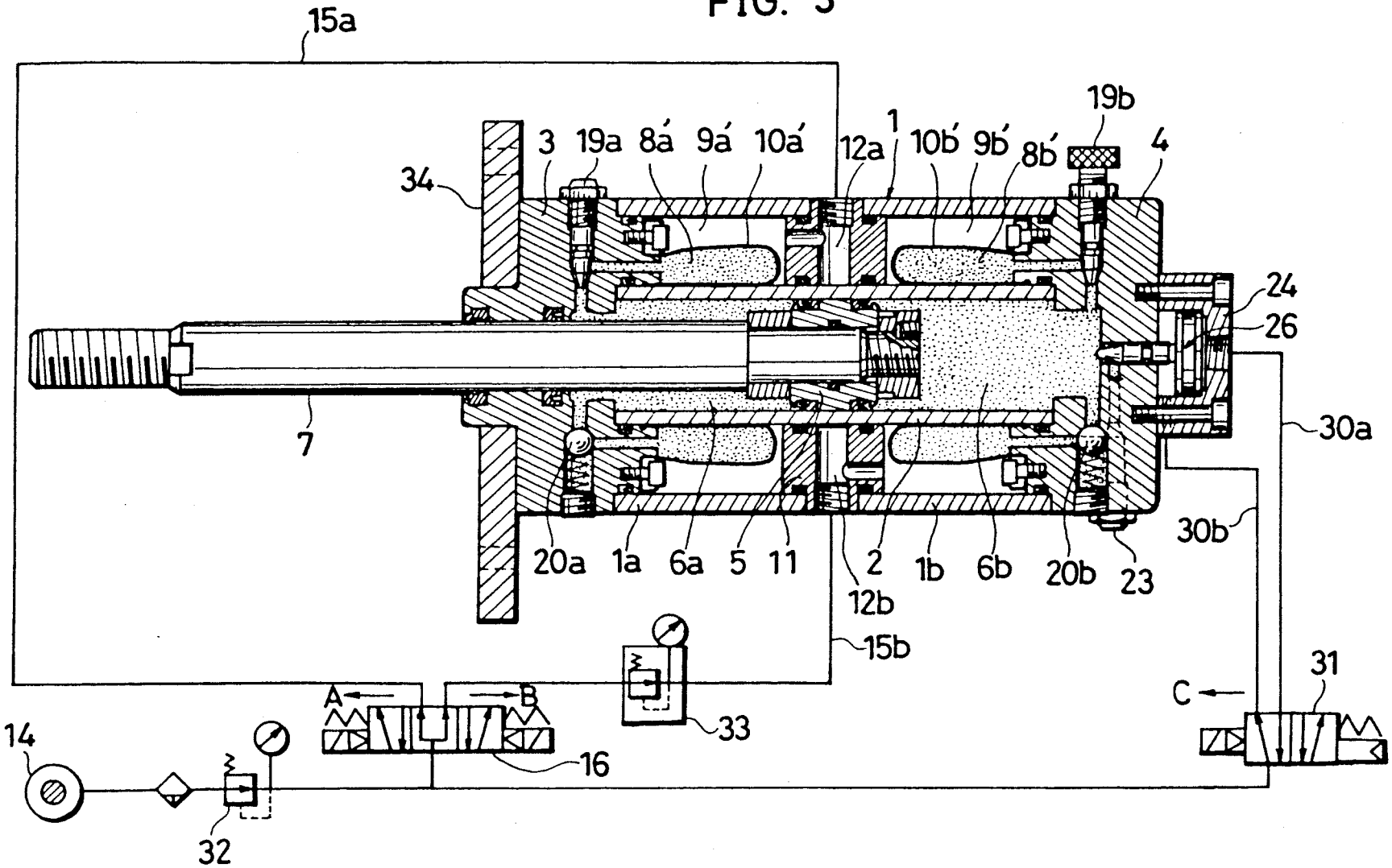
FiG. 3 is a side view, in longitudinal section, showing a hybrid cylinder device according to a second embodiment of the present invention.

FIG. 3 shows another hybrid cylinder device according to a second embodiment of the present invention. This modified cylinder device comprises a first outer oil chamber 8*a*' formed within a first interface rubber bag or bladder 10*a*', and a second outer oil chamber 8*b*' formed within a second interface rubber bag or bladder 10*b*'. The first and second bladders 10*a*', 10*b*' are respectively disposed within first and second air chambers 9*a*', 9*b*', so the volume of each bladder expands and contracts in response to pressure variations within the corresponding air chamber. The second embodiment is otherwise the same as the first embodiment.

According to the second embodiment, the respective bladders 10*a*', 10*b*' provide a larger pressure receiving area than the interface pistons 10*a*, 10*b* of the foregoing embodiment. Therefore, the cylinder device of the second embodiment is capable of providing a larger output than that of the first embodiment.

As clearly understood from the foregoing embodiments, the cylinder device according to the present invention relies on the compressed air source (compressor) 14 to take a drive power required for operation. Thus, it is not necessary to use special equipments, such as pipings, tanks and pumps, for constituting a hydraulic circuit whose requirements are much stricter than for a pneumatic circuit. Further, the air is infinitely available at all times, and may be discharged into the environment without inviting any pollution problems. In the case of a hydraulic circuit, a measure must be taken to compensate for losses of the working oil, whereas the pneumatic circuit does not call for such compensation to make the system substantially free of maintenance.

On the other hand, the cylinder device of the present invention also incorporates hydraulic portions to enable fine adjustment or control of operation. For example, the flow control passages 17*a*, 17*b*, 21 are hydraulic portions which rely only on the flow of the working oil which is substantially an incompressible fluid. Therefore, the oil flow through these control passages can be reliably adjusted by the corresponding flow regulating valves to enable exact speed or stroke control of the piston rod 7. As opposed to the hydraulic control, the pneumatic control can provide only approximate adjustment due to easy compressibility of the air.

In either of the two embodiments, the combination of the first inner oil chamber 6*a* and the first outer oil chamber 8*a* (8*a'*) forms one hydraulic unit acting on one side of the actuating piston 5, whereas the combination of the second inner oil chamber 6*b* and the second outer oil chamber 8*b* (8*b'*) forms another hydraulic unit acting on the other side of the actuating piston. In each hydraulic unit, the outer oil chamber serves as an pressure input portion for receiving the pressure from the corresponding air chamber, while the inner oil chamber serves as an pressure output portion for applying the thus received pressure to the actuating piston 5.

Obviously, the respective input oil chambers 8*a*, 8*b* (8*a'*, 8*b'*) of the two hydraulic units need not be arranged radially outwardly of the corresponding output oil chambers 6*a*, 6*b* as long as the input oil chambers are connected to the output oil chambers through the flow control passages 17*a*, 17*b* and arranged to adjoin the relevant air chambers 9*a*, 9*b* (9*a'*, 9*b'*). Thus, the use of the two coaxial tubes 2 is not always necessary.

Figure 4:
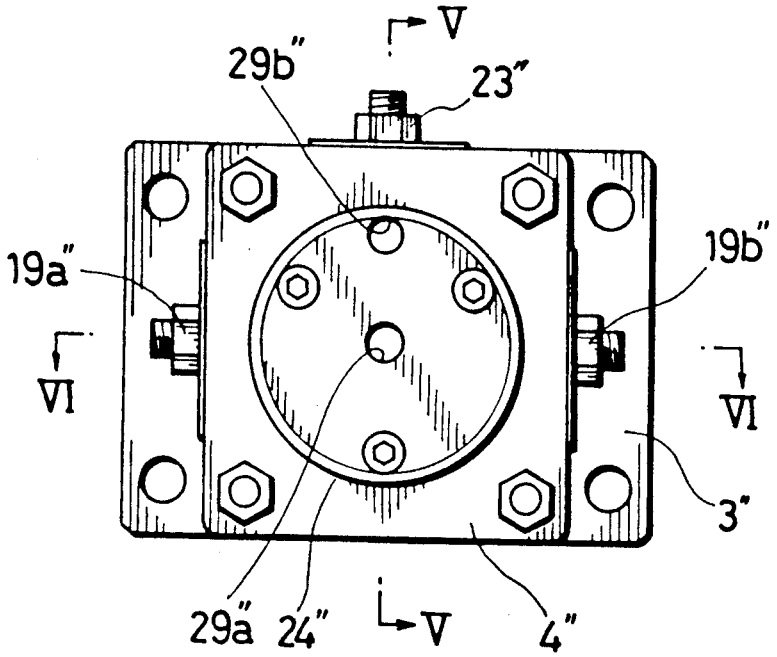
FIG. 4 is a view similar to FIG. 2 but showing a hybrid cylinder device according to a third embodiment of the present invention.
Figure 5:
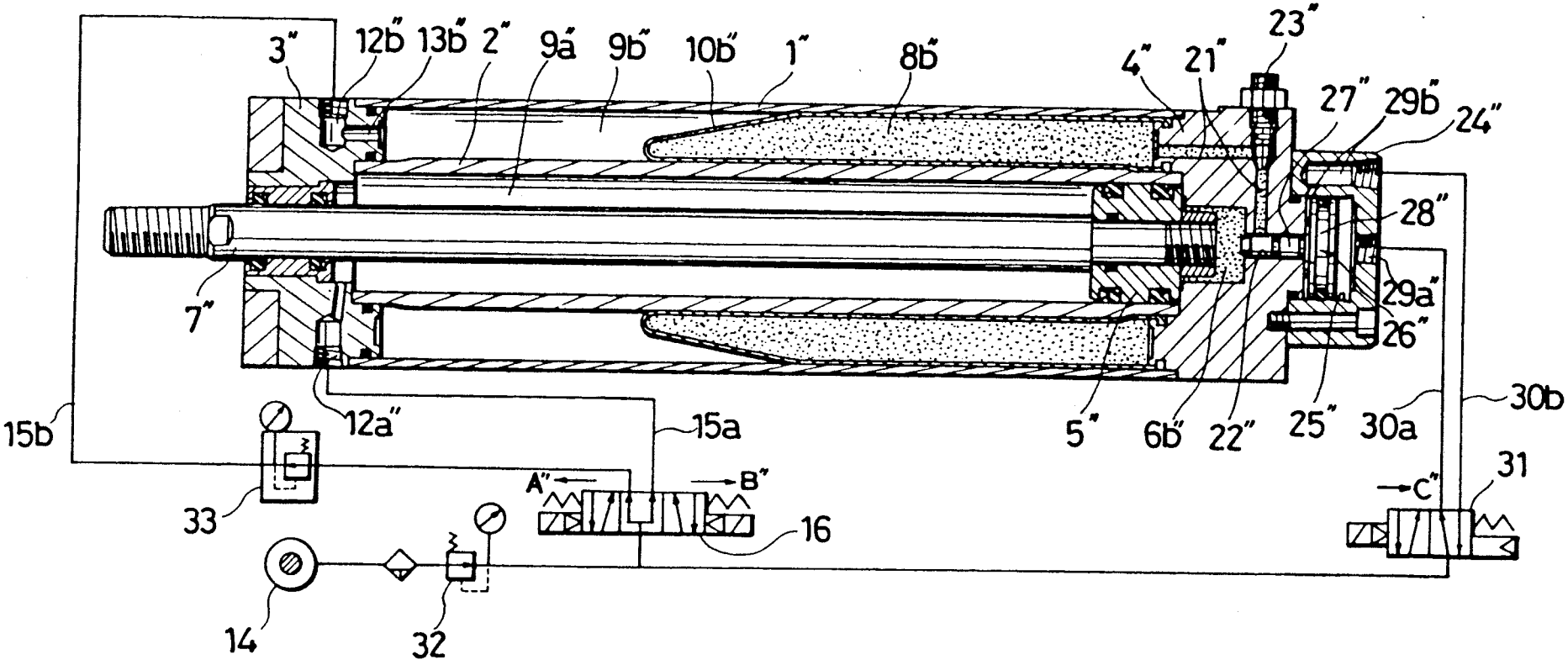
FIG. 5 is a sectional view taken on lines V—V in FIG. 4.
Figure 6:
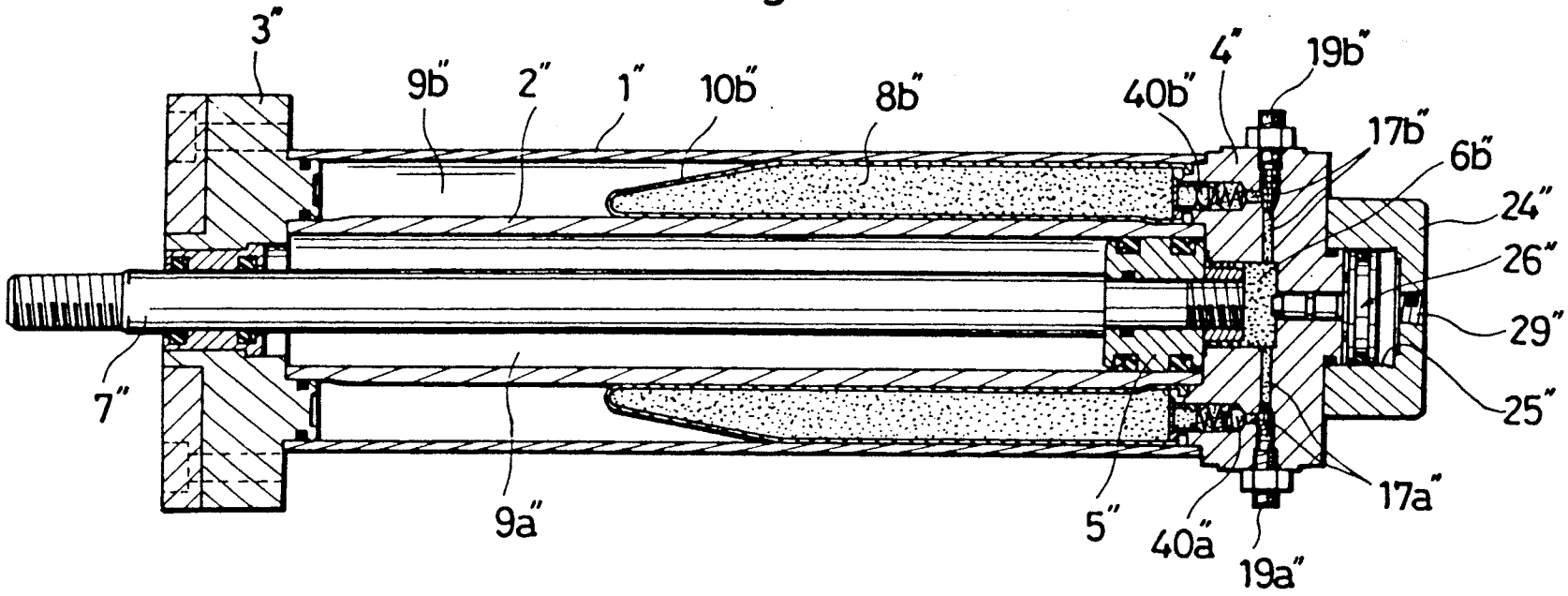
FIG. 6 is a sectional view taken on lines VI—VI in FIG. 4.

FIGS. 4 to 6 show a hybrid cylinder device according to a third embodiment of the present invention. The third embodiment basically differs from the foregoing embodiments in that a single hydraulic unit is used to hydraulically control piston rod movement in both axial directions.

Specifically, the cylinder device according to the third embodiment comprises an outer tube 1'', and an inner tube 2'' arranged coaxially within the outer tube, the two tubes being hermetically closed at both ends by a front cover 3'' and a rear cover 4''. Both tubes are rendered sufficiently long to provide a large reciprocating stroke for an actuating piston 5'' which is slidably guided in the inner tube to carry a piston rod 7''. In FIGS. 5 and 6, the piston is shown in its retreating limit position.

According to the third embodiment, a first air chamber 9*a''* is arranged within the inner tube 1'' to directly adjoin the actuating piston 5''. The first air chamber receives air supply through a first air supply port 12*a''* formed in the front cover 3''. The annular space between the two tubes 1'', 2'' is used only to provide a second air chamber 9*b''* and a single outer liquid chamber (input liquid chamber) 8*b''* separated from the second air chamber by means of an annular interface rubber bag 10*b''*. The front cover 3'' is formed with a second air supply port 12*b''* and a communication passage 13*b''* for supplying air into the second air Chamber. The rubber bag is hermetically connected to the rear cover 4''.

The rear cover 4'' is formed with a first flow control passage 17*a''* and a second flow control passage 17*b''*, as shown in FIG. 6. These flow control passages are respectively provided with first and second flow regulating valves 19*a''*, 19*b''*, and establish communication between the outer liquid chamber 8*b''* and an inner liquid chamber (output liquid chamber) 6*b''*. The inner liquid chamber is partially formed in the rear cover, but most of it provided in the inner tube 2'' on the side of the piston opposite the first air chamber 9*a''*, when the piston 5'' assumes an advanced position.

As shown in FIG. 6, the first flow control passage 17*a''* is further provided with a first check valve 40*a''* which allows liquid flow only from the inner liquid chamber 6*b''* to the outer liquid chamber 8*b''*. Similarly, the second flow control passage 17*b''* is further provided with a second check valve 40*b''* which permits liquid flow only from the outer liquid chamber to the inner liquid chamber. The purpose of these check valves will be described later.

The rear cover 4'' is further formed therein with an auxiliary flow control passage 21'' which communicates with the outer liquid chamber 8*b''* and a central bore 22'' of the rear cover, as shown in FIG. 5. The liquid flow through the auxiliary flow control passage can be controlled by an auxiliary flow regulating valve 23'' mounted on the rear cover. The purpose of the auxiliary flow control passage is to provide a stepwise speed control for the piston 5'', as is the case with the foregoing embodiments. However, according to the third embodiment, such stepwise speed control is possible both with respect to the advancing and retreating strokes of the piston, as described hereinafter.

Similarly to the foregoing embodiments, the central bore 22'' of the rear cover 4'' slidably receives a valve needle 27'' of a mode control valve 26'' which further has a pressure receiving disc 28'' slidably guided within a mode control box 24''. This mode control box is mounted on the rear cover, and has an inner space 25'' for receiving the valve disc. The mode control box further has a first control port 29*a''* for feeding air into the box inner space on one side of the valve disc, and a second control port 29*b''* for supplying air into the box inner space on the other side of the valve disc.

The pneumatic circuitry for driving the cylinder device of the third embodiment is substantially the same as already described in connection with the foregoing embodiments. Thus, such circuitry is not described here to avoid duplication.

It is now assumed that the valve needle 27'' takes its advanced position shown in FIG. 5 to close the auxiliary flow control passage 21'' relative to the central bore 22''. Thus, the auxiliary flow control passage is ineffective. In this condition, when the main change-over valve 16 is shifted in the direction of an arrow A'' from the illustrated neutral position, the second air chamber 9*b''* receives compressed air, whereas the first air chamber 9*a''* is held open to the atmosphere. As a result, the outer liquid chamber 8*b''* reduces in volume by deformation of the rubber bag 10*b''*, and the oil therein flows through the second flow control passage 17*b''* (FIG. 6) into the inner liquid chamber 6*b''* which thus increases in volume. Such volumetric increase of the inner liquid chamber causes the piston 5'' together with the piston rod 7'' to advance.

During the advancing stroke of the piston 5″, the second check valve 40*b*″ allows oil flow from the outer liquid chamber 8*b*″ to the inner liquid chamber 6*b*″ to thereby make effective the second flow control passage 17*b*″ and the second flow regulating valve 19*b*″. On the other hand, the first check valve 40*a*″ prohibits oil flow in the same flow direction to hold ineffective the first flow control passage 17*a*″ and the first flow regulating valve 19*a*′. Thus, the advancing stroke of the piston is accurately controlled only by the setting of the second flow regulating valve.

When the main changeover valve 16 is shifted in the direction of an arrow B′, the first air chamber 9*a*″ receives compressed air to directly act on the piston 5″, while the second air chamber 9*b*″ is held open to the atmosphere. As a result, the piston retreats to volumetrically reduce the inner liquid chamber 6*b*″, causing the oil to flow through the first flow control passage 17*a*″ into the outer liquid chamber 8*b*″. Due to the one-way flow function of the second check valve 40*b*″, the second flow control passage 17*b*″ together with the second flow regulating valve 19*b*″ is held ineffective. Thus, the retreating or returning movement of the piston is precisely controlled solely by the setting of the first flow regulating valve 19*a*″.

When the auxiliary changeover valve 31 is shifted in the direction of an arrow C″, the valve needle 27″ retreats to open the auxiliary flow control passage 21″ relative to the central bore 22″. This auxiliary flow control passage, as long as it is thus open, allows oil flow from the outer liquid chamber 8*b*″ to the inner liquid chamber 6*b*″ and vice versa. Therefore, it is possible to control the moving speed of the piston 5″ in a stepwise fashion both in the advancing and retreating directions by opening and closing the auxiliary flow control passage.

The third embodiment illustrated in FIGS. 4 to 6 is advantageous in that the single hydraulic unit is utilized to hydraulically control the piston movement in both axial directions, thereby simplifying the overall structure of the bidirectional control type cylinder device. Further, the reciprocating stroke of the piston 5″ can be made large by enlarging the maximum volume of the rubber bag 10*b*″ (i.e. the outer liquid chamber 8*b*″) since a considerable portion of the annular space between the two tubes 1″, 2″ can be used for arranging the rubber bag.

The present invention being thus described, it is obvious that the same may be varied in many other ways. For instance, the cylinder device of the present invention does not necessarily require the auxiliary flow control passage 21, 21″, the auxiliary flow regulating valve 23, 23″, the central bore 22, 22″, the mode control box 24, 24″, the mode control valve 26, 26″, and the auxiliary changeover valve 31, 31″ if the stepwise speed control of the piston rod 7, 7″ is not called for. Such variations are not to be regarded as a departure from the spirit and scope of the present invention, and all such modifications as would be obvious to those skilled in the art are intended to be included within the scope of the following claims.

I claim:

1. A hydraulic-pneumatic cylinder device comprising:

tubular housing means hermetically closed at both ends;

an actuating piston axially slidably guided within said tubular housing means;

a piston rod connected to said piston and axially extending in said housing means to project out through one end thereof;

an air chamber disposed within said housing means, said air chamber being pressurizable to cause movement of said piston in one axial direction;

a hydraulic unit associated with said air chamber and arranged within said housing means to act on one side of said piston, said hydraulic unit including an input liquid chamber adjoining said air chamber via interface means, an output liquid chamber adjoining said one side of said actuating piston, and at least one flow control passage provided with adjustable flow control means and communicating with said input and output liquid chambers, said interface means being capable of allowing volumetric variation of said input liquid chamber, said output liquid chamber being variable in volume in complementary relation to the volumetric variation of said input liquid chamber to cause axial movement of said actuating piston; and complementing means arranged within said housing means to act on the other side of said piston for causing movement thereof in the opposite axial direction;

wherein said interface means comprises an annular flexible bag defining therein said input liquid chamber, said bag including an annular radially inner portion, an annular radially outer portion, an annular closure end, and an annular open end, said closure end of said bag being non-fixed, said open end of said bag being fixed and held in communication with said output liquid chamber, wherein said annular radially inner portion and said annular radially outer portions both have a surface, and wherein the surface of aid annular radially inner portion and the surface of said annular radially outer portion merge smoothly with each other at said annular closure end.

2. The cylinder device as defined in claim 1, wherein said hydraulic unit further comprises at least one auxiliary flow control passage provided with adjustable flow Control means and communicatable with said input and output liquid chambers, said auxiliary flow control passage being selectively openable and closable by a mode control valve which is controlled pneumatically.

3. The cylinder device as defined in claim 1, wherein said complementing means comprises an additional air chamber arranged within said housing means, said additional air chamber being pressurizable to cause movement of said piston in said opposite axial direction.

4. The cylinder device as defined in claim 3, wherein one of said air chambers receives a higher air pressure than the other air chamber.

5. The cylinder device as defined in claim 3, wherein said complementing means further comprises an additional hydraulic unit associated with said additional air chamber and arranged within said housing means to act on said other side of said actuating piston; and said additional hydraulic unit includes an additional input liquid chamber adjoining said additional air chamber via additional interface means, an additional output liquid chamber adjoining said other side of said piston, and at least one additional flow control passage provided with additional adjustable flow control means and communicating with said additional input and output liquid chambers, said additional interface means being capable of allowing volumetric variation of said additional input liquid chamber, said additional output liquid chamber being variable in volume in complemetary relation to the volumetric variation of said additional input liquid chamber to cause axial movement of said piston.

6. The cylinder device as defined in claim 5, wherein each of said hydraulic units further comprises at least one return passage communicating with the corresponding input and output liquid chambers, said return passage being provided with a check valve which allows liquid flow only from said corresponding output liquid chamber to said corresponding input liquid chamber.

7. The cylinder device as defined in claim 5, wherein said additional interface means is in the form of an additional annular flexible bag defining therein said additional input liquid chamber, said additional bag including an annular radially inner portion, an annular radially outer portion, an annular closure end, and an annular open end, said closure end of said additional bag being non-fixed, said open end of said additional bag being fixed and held in communication with said additional output liquid chamber.

8. The cylinder device as defined in claim 3, wherein said additional air chamber directly adjoins said other side of said actuating piston.

9. The cylinder device as defined in claim 8, wherein said flow control passage is provided with a check valve for allowing liquid flow only from said input liquid chamber to said output liquid chamber, said hydraulic unit further including an additional flow control passage which is provided with adjustable flow control means and communicating with said input and output liquid chambers, said additional flow control passage being further provided with an additional check valve for allowing liquid flow only from said output liquid chamber to said input liquid chamber.

10. The cylinder device as defined in claim 3, wherein said housing means comprises an inner tube in which said actuating piston is slidably guided, and an outer tube arranged coaxially with said inner tube to define an annular space around said inner tube, said output liquid chamber being arranged within said inner tube on said one side of said actuating piston, said input liquid chamber and the corresponding air chamber being arranged in said annular space and separated from each other by said annular bag which is arranged to surround said inner tube.

11. The cylinder device as defined in claim 10, wherein said housing means further comprises a pair of end covers hermetically closing said inner and outer tubes at both ends of said housing means, one end cover being formed therein with said flow control passage, said flow control means being in the form of a flow regulating valve mounted on said one end cover to project into said flow control passage.

12. The cylinder device as defined in claim 11, wherein said one end cover is further formed with a central bore as well as with an auxiliary flow control passage, said auxiliary flow control passage being provided with an auxiliary flow regulating valve mounted on said one end cover, said central bore communicating with said output liquid chamber, said auxiliary flow control passage communicating with said input chamber and opening into said central bore, said central bore slidably guiding a valve needle of a mode control valve to selectively open and close said auxiliary flow control passage relative to said central bore in response to sliding movement of said valve needle.

13. The cylinder device as defined in claim 12, wherein said mode control valve has a pressure receiving disc slidably guided within an inner space of a mode control box which is mounted to said one end cover, said mode control box being formed with a first port for allowing air entry into said inner space on one side of said disc as well as a second port for allowing air entry into said inner space on the other side of said disc.

14. The cylinder device as defined in claim 11, wherein said additional air chamber is arranged within said annular space between said inner and outer tubes; and said complementing means further comprises an additional hydraulic unit associated with said additional air chamber to act on said other side of said actuating piston.

15. The cylinder device as defined in claim 14, wherein said additional hydraulic unit includes an additional input liquid chamber arranged within said annular space to adjoin said additional air chamber via additional interface means, an additional output liquid chamber arranged within said inner tube to adjoin said other side of said piston, and at least one additional flow control passage formed in the other end cover to communicate with said additional input and output liquid chambers, said additional flow control passage being provided with an additional flow regulating valve mounted on said other end cover to project into said additional flow control passage, said additional interface means being capable of allowing volumetric variation of said additional input liquid chamber, said additional output liquid chamber being variable in volume in complementary relation to the volumetric variation of said additional input liquid chamber to cause axial movement of said piston.

16. The cylinder device as defined in claim 15, wherein each of said end covers is further formed with a return passage communicating with the corresponding input and output liquid chambers, said return passage being provided with a check valve mounted on said each end cover for allowing liquid flow only from said corresponding output liquid chamber to said corresponding input liquid chamber.

17. The cylinder device as defined in claim 15, wherein said additional interface means is in the form of an additional annular flexible bag arranged within said annular space to define therein said additional input liquid chamber, said additional bag including an annular radially inner portion, an annular radially outer portion, an annular closure end, and an annular open end, said closure end of said additional bag being nonfixed, said open end of said additional bag being fixed and held in communication with said additional output liquid chamber.

18. The cylinder device as defined in claim 15, wherein said outer tube comprises a pair of tubular segments hermetically separated from each other but joined together by means of an annular intermediate connector, said two air chambers being arranged respectively on both sides of said intermediate connector within said annular space, said intermediate connector having a first air supply port communicating with one of said air chambers, said intermediate connector further having a second air supply port communicating with the other air chamber.

19. The cylinder device as defined in claim 11, wherein said additional air chamber is arranged within said inner tube to directly adjoin said other side of said actuating piston.

20. The cylinder device as defined in claim 19, wherein said flow control passage is provided with a check valve for allowing liquid flow only from said input liquid chamber to said output liquid chamber, said one end cover being further formed therein with an additional flow control passage which is provided with an additional flow regulating valve mounted on said one end cover to project into said additional flow control passage, said additional flow control passage further being provided with an additional check valve for allowing liquid flow only from said output liquid chamber to said input liquid chamber.

21. The cylinder device as defined in claim 19, wherein the other end cover is formed with a first air supply port communicating with one of said two air chambers, said other end cover being further formed with a second air supply port communicating with the other air chamber.

* * * * *